US009416454B2

(12) United States Patent
Chen et al.

(10) Patent No.: US 9,416,454 B2
(45) Date of Patent: Aug. 16, 2016

(54) METHOD FOR CONVERSION TREATING SURFACE OF MAGNESIUM ALLOY WORKPIECE

(71) Applicants: Fu Zhun Precision Industry (Shen Zhen) Co., Ltd., Shenzhen (CN); Foxconn Technology Co., Ltd., New Taipei (TW)

(72) Inventors: Hao-Wei Chen, Shenzhen (CN); Wu-Bin Li, Shenzhen (CN); Yong-Hui Gao, Shenzhen (CN); Kun Qian, Shenzhen (CN)

(73) Assignees: Fu Zhun Precision Industry (Shen Zhen) Co., Ltd., Shenzhen (CN); Foxconn Technology Co., Ltd., New Taipei (TW)

( * ) Notice: Subject to any disclaimer, the term of this patent is extended or adjusted under 35 U.S.C. 154(b) by 257 days.

(21) Appl. No.: 14/201,930

(22) Filed: Mar. 10, 2014

(65) Prior Publication Data

US 2014/0261896 A1 Sep. 18, 2014

(30) Foreign Application Priority Data

Mar. 12, 2013 (CN) ..... 2013 1 00781340

(51) Int. Cl.

| | |
|---|---|
| ***C23G 1/00*** | (2006.01) |
| ***C23C 22/42*** | (2006.01) |
| ***C23C 22/80*** | (2006.01) |
| ***C23G 1/12*** | (2006.01) |
| ***C23G 1/22*** | (2006.01) |

(52) U.S. Cl.

CPC ..... *C23C 22/42* (2013.01); *C23C 22/80* (2013.01); *C23G 1/00* (2013.01); *C23G 1/12* (2013.01); *C23G 1/22* (2013.01)

(58) Field of Classification Search

CPC ..... C23C 22/42; C23C 22/80; C23G 1/00; C23G 1/12; C23G 1/22

See application file for complete search history.

(56) References Cited

U.S. PATENT DOCUMENTS

| | | | | |
|---|---|---|---|---|
| 2003/0213771 | A1* | 11/2003 | Ohshita | C23C 22/18 216/83 |
| 2009/0159096 | A1* | 6/2009 | Hsu | C23C 22/18 134/3 |
| 2011/0155287 | A1* | 6/2011 | Hsu | C23C 22/60 148/259 |

FOREIGN PATENT DOCUMENTS

| | | | |
|---|---|---|---|
| CN | 1686640 | A | 10/2005 |
| CN | 101463475 | A | 6/2009 |
| CN | 101638780 | A | 2/2010 |
| CN | 201447503 | U | 5/2010 |
| TW | 544474 | B | 8/2003 |

OTHER PUBLICATIONS

English Machine translation of CN 102677035 Sep. 2012.*

* cited by examiner

*Primary Examiner* — Veronica F Faison

(74) *Attorney, Agent, or Firm* — ScienBiziP, P.C.

(57) ABSTRACT

A method for conversion treating a surface of a magnesium alloy workpiece includes the following steps: providing a magnesium alloy workpiece, degreasing the magnesium alloy workpiece, acid pickling the magnesium alloy workpiece in a first acid pickling treatment step, surface conditioning the magnesium alloy workpiece in a first surface conditioning treatment step, acid pickling the magnesium alloy workpiece in a second acid pickling treatment step, surface conditioning the magnesium alloy workpiece in a second surface conditioning treatment step, pre-phosphating the magnesium alloy workpiece in a pre-phosphating treatment step, and phosphating the magnesium alloy workpiece in a phosphating treatment step to form a phosphating film on the surface of the magnesium alloy workpiece.

18 Claims, 6 Drawing Sheets

The steps and the parameters of embodiment 1 through embodiment 4

| Step | Embodiment 1 | | | Embodiment 2 | | | Embodiment 3 | | | Embodiment 4 | | |
|---|---|---|---|---|---|---|---|---|---|---|---|---|
| | Time (min) | Tempera-ture (°C) | PH | Time (min) | Tempera-ture (°C) | PH | Time (min) | Tempera-ture (°C) | PH | Time (min) | Tempera-ture (°C) | PH |
| Degreasing | 5 | 75 | -- | 10 | 60 | -- | 7 | 80 | -- | 7 | 80 | -- |
| First acid pickling treatment | 0.5 | 70 | -- | 1 | 64 | -- | 0.67 | 65 | -- | 0.83 | 60 | -- |
| First surface conditioning treatment | 0.5 | 84 | -- | 1 | 80 | -- | 0.83 | 86 | -- | 1 | 90 | -- |
| Second acid pickling treatment | 3 | 60 | -- | 2 | 65 | -- | 2.5 | 60 | -- | 1.5 | 70 | -- |
| Second surface conditioning treatment | 3 | 84 | -- | 2 | 70 | -- | 3 | 85 | -- | 2 | 90 | -- |
| Pre-phosphating treatment | 0.17 | 25 | 1.75 | 0.33 | 27 | 1.8 | 0.42 | 20 | 1.86 | 0.25 | 35 | 1.9 |
| Phosphating treatment | 0.42 | 25 | 2.05 | 0.33 | 27 | 1.95 | 0.25 | 20 | 2.0 | 0.67 | 35 | 2.15 |

FIG. 2

The steps and the parameters of comparative embodiment 1 through comparative embodiment 5

| Step | Comparative embodiment 1 | | | Comparative embodiment 2 | | | Comparative embodiment 3 | | | Comparative embodiment 4 | | | Comparative embodiment 5 | | |
|---|---|---|---|---|---|---|---|---|---|---|---|---|---|---|---|
| | Time (min) | Tempera-ture (°C) | PH | Time (min) | Tempera-ture (°C) | PH | Time (min) | Tempera-ture (°C) | PH | Time (min) | Tempera-ture (°C) | PH | Time (min) | Tempera-ture (°C) | PH |
| Degreasing | 7 | 70 | - | 7 | 70 | - | 7.5 | 70 | - | 8 | 65 | - | 6 | 75 | - |
| First acid pickling treatment | 0.5 | 70 | - | 3 | 50 | - | 2 | 60 | - | 1 | 65 | - | 2.5 | 55 | - |
| First surface conditioning treatment | 0.5 | 80 | - | 3 | 70 | - | 2 | 80 | - | 1 | 85 | - | 2.5 | 75 | - |
| Second acid pickling treatment | -(Canceled) | | | 1 | 65 | - | 2 | 60 | - | 3 | 50 | - | 0.5 | 70 | - |
| Second surface conditioning treatment | -(Canceled) | | | 2 | 70 | - | 1 | 85 | - | 2 | 80 | - | 0.5 | 90 | - |
| Pre-phosphating treatment | 0.17 | 30 | 1.75 | -(Canceled) | | | 0.75 | 18 | 2.3 | 0.83 | 18 | 1.6 | 0.13 | 40 | 1.6 |
| Phosphating treatment | 0.17 | 30 | 1.95 | 0.33 | 30 | 1.8 | 0.13 | 40 | 1.6 | 0.75 | 18 | 2.3 | 50 | 18 | 1.6 |

FIG. 3

Surface resistance and corrosion resistance of embodiment 1 through embodiment 4

| Embodiment | Sample NO. | Surface resistance (ohm) | | | | | Corrosion resistance (grade) |
|---|---|---|---|---|---|---|---|
| | | Test point 1 | Test point 2 | Test point 3 | Test point 4 | Test point 5 | |
| Embodiment 1 | 1# | 0.28 | 0.37 | 0.43 | 0.33 | 0.46 | 9 grade |
| | 2# | 0.38 | 0.32 | 0.35 | 0.42 | 0.46 | 9 grade |
| | 3# | 0.52 | 0.49 | 0.28 | 0.33 | 0.37 | 9 grade |
| | 4# | 0.50 | 0.55 | 0.55 | 0.38 | 0.33 | 9 grade |
| | 5# | 0.62 | 0.28 | 0.57 | 0.39 | 0.54 | 8 grade |
| Embodiment 2 | 1# | 0.41 | 0.42 | 0.63 | 0.28 | 0.31 | 9 grade |
| | 2# | 0.22 | 0.23 | 0.23 | 0.35 | 0.49 | 8 grade |
| | 3# | 0.43 | 0.23 | 0.37 | 0.53 | 0.65 | 9 grade |
| | 4# | 0.69 | 0.75 | 0.53 | 0.63 | 0.55 | 9 grade |
| | 5# | 0.29 | 0.66 | 0.55 | 0.59 | 0.36 | 9 grade |
| Embodiment 3 | 1# | 0.44 | 0.36 | 0.74 | 0.15 | 0.26 | 9 grade |
| | 2# | 0.46 | 0.75 | 0.62 | 0.54 | 0.5 | 8 grade |
| | 3# | 0.73 | 0.75 | 0.4 | 0.45 | 0.45 | 9 grade |
| | 4# | 0.64 | 0.61 | 0.48 | 0.34 | 0.26 | 9 grade |
| | 5# | 0.45 | 0.3 | 0.49 | 0.5 | 0.31 | 9 grade |
| Embodiment 4 | 1# | 0.11 | 0.34 | 0.55 | 0.28 | 0.39 | 9 grade |
| | 2# | 0.41 | 0.54 | 0.21 | 0.49 | 0.29 | 9 grade |
| | 3# | 0.27 | 0.51 | 0.53 | 0.39 | 0.22 | 8 grade |
| | 4# | 0.33 | 0.53 | 0.52 | 0.47 | 0.64 | 9 grade |
| | 5# | 0.36 | 0.32 | 0.27 | 0.49 | 0.31 | 9 grade |

FIG. 4

Surface resistance and corrosion resistance of comparative embodiment 1 through comparative embodiment 5

| Embodiment | Sample NO. | Surface resistance (ohm) | | | | | Corrosion resistance (grade) |
|---|---|---|---|---|---|---|---|
| | | Test point 1 | Test point 2 | Test point 3 | Test point 4 | Test point 5 | |
| Comparative embodiment 1 | 1# | 2.23 | 2.34 | 5.20 | 1.20 | 1.68 | 7 grade |
| | 2# | 3.25 | 0.69 | 0.89 | 1.20 | 2.71 | 9 grade |
| | 3# | 6.20 | 4.20 | 3.25 | 5.27 | 5.29 | 7 grade |
| | 4# | 2.00 | 2.57 | 4.27 | 3.33 | 2.82 | 7 grade |
| | 5# | 1.24 | 1.29 | 2.08 | 2.37 | 1.54 | 6 grade |
| Comparative embodiment 2 | 1# | 5.68 | 2.57 | 8.21 | 9.24 | 6.24 | 4 grade |
| | 2# | 2.43 | 7.24 | 5.32 | 3.25 | 10.20 | 6 grade |
| | 3# | 9.25 | 15.01 | 12.11 | 6.78 | 8.77 | 6 grade |
| | 4# | 11.24 | 5.78 | 8.83 | 4.22 | 1.29 | 5 grade |
| | 5# | 2.33 | 5.44 | 8.25 | 11.30 | 10.50 | 5 grade |
| Comparative embodiment 3 | 1# | 1.02 | 2.01 | 2.22 | 5.24 | 1.09 | 8 grade |
| | 2# | 3.52 | 0.58 | 5.28 | 6.24 | 6.24 | 7 grade |
| | 3# | 7.25 | 1.25 | 8.28 | 4.28 | 4.21 | 7 grade |
| | 4# | 10.05 | 4.25 | 3.21 | 4.24 | 7.25 | 6 grade |
| | 5# | 6.25 | 9.89 | 4.25 | 4.28 | 8.22 | 8 grade |
| Comparative embodiment 4 | 1# | 8.35 | 17.25 | 5.24 | 24.0 | 5.23 | 7 grade |
| | 2# | 8.24 | 4.26 | 14.25 | 32.1 | 5.77 | 6 grade |
| | 3# | 15.23 | 17.22 | 18.22 | 24.25 | 32.22 | 6 grade |
| | 4# | 7.25 | 5.25 | 3.24 | 4.25 | 6.22 | 5 grade |
| | 5# | 8.25 | 7.25 | 1.88 | 2.92 | 2.35 | 4 grade |
| Comparative embodiment 5 | 1# | 5.57 | 6.25 | 8.22 | 15.22 | 2.24 | 5 grade |
| | 2# | 6.25 | 40.01 | 8.62 | 6.25 | 5.21 | 6 grade |
| | 3# | 10.24 | 9.25 | 4.25 | 3.25 | 8.32 | 5 grade |
| | 4# | 2.01 | 5.24 | 7.26 | 9.99 | 12.22 | 5 grade |
| | 5# | 15.20 | 8.72 | 16.25 | 3.35 | 9.54 | 5 grade |

FIG. 5

METHOD FOR CONVERSION TREATING SURFACE OF MAGNESIUM ALLOY WORKPIECE

FIELD

The present disclosure relates to a method for conversion treating a surface of a magnesium alloy workpiece.

BACKGROUND

Magnesium alloy is light, has high strength, and is recyclable, so it is widely used in automobiles and electronics. However, because the magnesium alloy is reactive and has poor corrosion resistance, there is a need to form a protective film on a surface of the magnesium alloy.

The conventional method for forming a chemical conversion film on the surface of the magnesium alloy is a conversion treating method, in order to enhance a corrosion resistance of the magnesium alloy, and to enhance adhesion of the surface thereof with a coating layer. When the magnesium alloy is used in a housing of a mobile phone or other electronic communication device, the resistance of the chemical conversion film reflects electromagnetic shielding of the assembly. For example, the electromagnetic shielding of the assembly is poor when the resistance is too high. However, the resistance of the chemical conversion film made by the conventional conversion treating method is generally higher, and it is difficult to meet the needs of the electronic communication device.

BRIEF DESCRIPTION OF THE DRAWINGS

The components in the drawings are not necessarily drawn to scale, the emphasis instead being placed upon clearly illustrating the principles of the present disclosure. Moreover, in the drawings, like reference numerals designate corresponding parts throughout several views.

FIG. 2 is a table showing steps and parameters of embodiment 1 through embodiment 4.

FIG. 3 is a table showing steps and parameters of comparative embodiment 1 through comparative embodiment 5.

FIG. 4 is a table showing surface resistance and corrosion resistance of embodiment 1 through embodiment 4.

FIG. 5 is a table showing surface resistance and corrosion resistance of comparative embodiment 1 through comparative embodiment 5.

DETAILED DESCRIPTION

Figure 1:
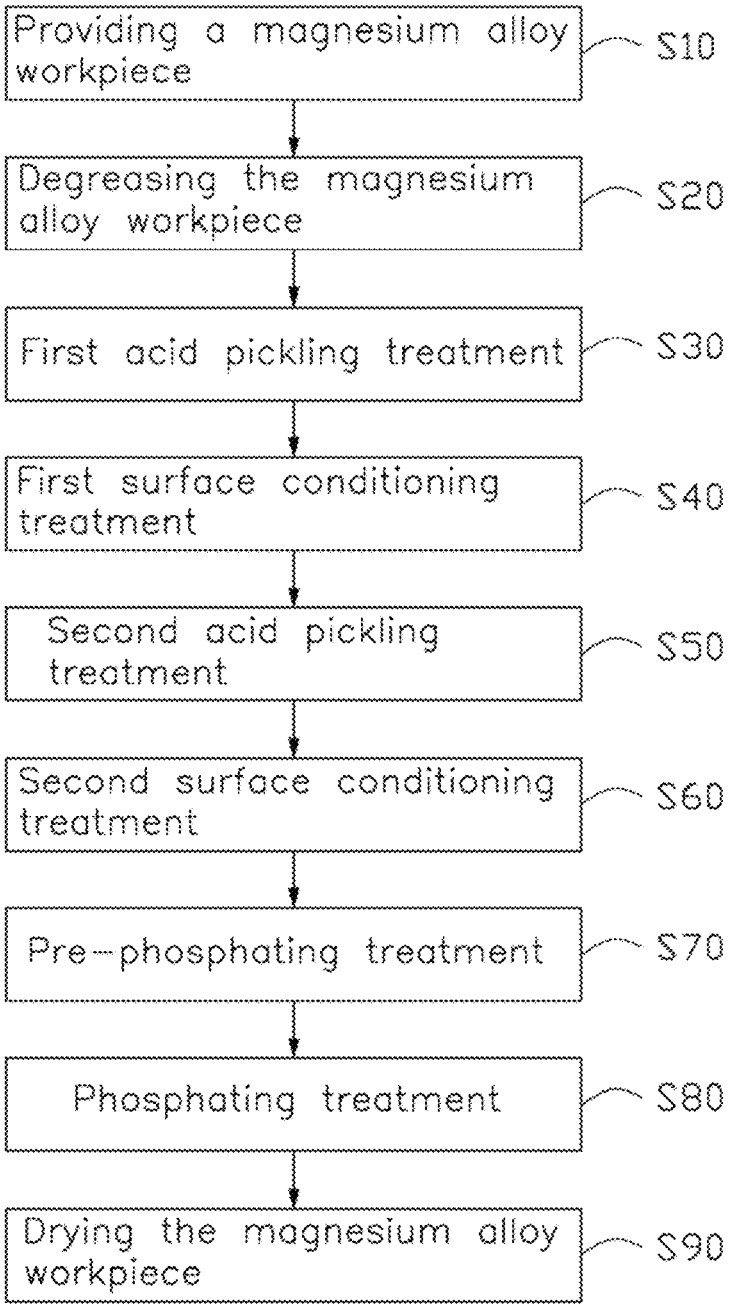
FIG. 1 is a flowchart of an embodiment of a method for conversion treating a surface of a magnesium alloy workpiece.

FIG. 1 shows a flowchart of an embodiment of a method for conversion treating a surface of a magnesium alloy workpiece.

In step S10, a magnesium alloy workpiece is provided.

In step S20, the magnesium alloy workpiece is degreased to remove oil from a surface thereof. Degreasing the surface of the magnesium alloy makes the surface of the magnesium alloy to be hydrophilic, and a continuous moisture film is formed on the surface thereof. A time period or duration of the degreasing step is in a range from about 5 minutes to about 10 minutes, and a temperature of the degreasing step is in a range from about 60 degrees Celsius/centigrade to about 80 degrees Celsius/centigrade. A degreasing solution comprises sodium hydroxide, sodium carbonate, and sodium silicate. A mass concentration of the sodium hydroxide is in a range from about 10 grams per liter (g/L) to about 40 grams per liter (g/L), a mass concentration of the sodium carbonate is in a range from about 20 g/L to about 30 g/L, and a mass concentration of the sodium silicate is in a range from about 30 g/L to about 50 g/L.

In step S30, the magnesium alloy workpiece is placed in a first acid pickling solution to remove oxides, release agent, dirt, and magnesium granules left behind or formed in cold working step, such as cutting process, from the surface of the magnesium alloy workpiece. A time period or duration of the first acid pickling treatment step is in a range from about 0.5 minute to about 1 minute, and a temperature of the first acid pickling solution is in a range from about 60 degrees Celsius/centigrade to about 70 degrees Celsius/centigrade. The first acid pickling solution comprises oxalic acid, sodium dodecyl sulfate (SDS), and oleic acid diethanolamide (ODEA). A volume concentration of the oxalic acid is in a range from about 20 milliliters per liter (mL/L) to about 60 milliliters per liter (mL/L), a mass concentration of the SDS is in a range from about 10 g/L to about 20 g/L, and a mass concentration of the ODEA is in a range from about 3 g/L to about 8 g/L.

In step S40, the magnesium alloy workpiece is placed in a first surface conditioning solution to remove any residue left behind on the surface of the magnesium alloy workpiece after the first acid pickling treatment step. A time period of the first surface conditioning treatment step is in a range from about 0.5 minute to about 1 minute, a temperature of the first surface conditioning treatment step is in a range from about 80 degrees centigrade to about 90 degrees centigrade. The first surface conditioning solution comprises sodium hydroxide, potassium hydroxide, and SDS. A mass concentration of the sodium hydroxide is in a range from about 50 g/L to about 90 g/L, a mass concentration of the potassium hydroxide is in a range from about 50 g/L to about 70 g/L, and a mass concentration of the SDS is in a range from about 5 g/L to about 15 g/L.

In step S50, the magnesium alloy workpiece is placed in a second acid pickling solution to further remove oxides, release agent, dirt and magnesium granules left behind or formed in cold working step, such as cutting process, from the surface of the magnesium alloy workpiece. A time period of the second acid pickling treatment step is in a range from about 1.5 minutes to about 3 minutes, and a temperature of the second acid pickling solution is in a range from about 60 degrees centigrade to about 70 degrees centigrade. The second acid pickling solution comprises oxalic acid, SDS, and ODEA. A volume concentration of the oxalic acid is in a range from about 20 mL/L to about 60 mL/L, a mass concentration of the SDS is in a range from about 10 g/L to about 20 g/L, and a mass concentration of the ODEA is in a range from about 3 g/L to about 8 g/L.

In step S60, the magnesium alloy workpiece is placed in a second surface conditioning solution to remove any residue left on the surface of the magnesium alloy workpiece after the second acid pickling treatment step. A time period of the second surface conditioning treatment step is in a range from about 2 minutes to about 3 minutes, and a temperature of the second surface conditioning treatment step is in a range from about 70 degrees centigrade to about 90 degrees centigrade. The second surface conditioning solution comprises sodium hydroxide, potassium hydroxide, and SDS. A mass concentration of the sodium hydroxide is in a range from about 50 g/L to about 90 g/L, a mass concentration of the potassium hydroxide is in a range from about 50 g/L to about 70 g/L, and a mass concentration of the SDS is in a range from about 5 g/L to about 15 g/L.

In step S70, the magnesium alloy workpiece is placed in a pre-phosphating solution to neutralize any residual solution left on the surface of the magnesium alloy workpiece from the second surface conditioning treatment step. A time period of the pre-phosphating treatment step is in a range from about 10 seconds to about 25 seconds, and a temperature of the pre-phosphating solution is in a range from about 20 degrees centigrade to about 35 degrees centigrade. The pre-phosphating solution comprises phosphoric acid, manganese phosphate acid, calcium dihydrogen phosphate, sodium zirconate, sodium vanadate, sodium molybdate, and sodium silicate. A volume concentration of the phosphoric acid is in a range from about 30 mL/L to about 100 mL/L, a mass concentration of the manganese phosphate acid is in a range from about 10 g/L to about 40 g/L, a mass concentration of the calcium dihydrogen phosphate is in a range from about 5 g/L to about 20 g/L, a mass concentration of the sodium zirconate is in a range from about 1 g/L to about 10 g/L, a mass concentration of the sodium vanadate is in a range from about 1 g/L to about 4 g/L, a mass concentration of the sodium molybdate is in a range from about 0.5 g/L to about 2 g/L, and a mass concentration of the sodium silicate in a range from about 0.5 g/L to about 3 g/L. A pH value of the pre-phosphating solution is in a range from about 1.75 to about 1.9.

In step S80, the magnesium alloy workpiece is placed into a phosphating solution to form a phosphating film on the surface of the magnesium alloy workpiece. A time period of the phosphating treatment step is in a range from about 15 seconds to about 40 seconds, and a temperature of the phosphating solution is in a range from about 20 degrees centigrade to about 35 degrees centigrade. The phosphating solution is selected from a group consisting of phosphoric acid, manganese phosphate acid, calcium dihydrogen phosphate, sodium zirconate, sodium vanadate, sodium molybdate, and sodium silicate. A volume concentration of the phosphoric acid is in a range from about 30 mL/L to about 100 mL/L, a mass concentration of the manganese phosphate acid is in a range from about 10 g/L to about 40 g/L, a mass concentration of the calcium dihydrogen phosphate is in a range from about 5 g/L to about 20 g/L, a mass concentration of the sodium zirconate is in a range from about 1 g/L to about 10 g/L, a mass concentration of the sodium vanadate is in a range from about 1 g/L to about 4 g/L, a mass concentration of the sodium molybdate is in a range from about 0.5 g/L to about 2 g/L, and a mass concentration of the sodium silicate is in a range from about 0.5 g/L to about 3 g/L. A pH value of the phosphating solution is in a range from about 1.95 to about 2.15.

In step S90, the magnesium alloy workpiece is dried.

Between step S20 and step S80, there may be another step for washing the magnesium alloy workpiece.

It is to be understood that the above-described solutions may include other ingredients. For example, the degreasing solution can only include an aqueous solution of sodium hydroxide or sodium phosphate, as long as the aqueous solution can remove the oil from the surface of the magnesium alloy workpiece, to make the surface of the magnesium alloy workpiece hydrophilic, and forming a continuous moisture film on the surface. It is to be understood that if the magnesium alloy workpiece has been treated with a sandblasting process before step S20, the oils and the like on the surface of the magnesium alloy workpiece have already been removed, and step S20 can be omitted.

It is to be understood that the first and second surface conditioning solutions may comprise other ingredients, such as a citric acid aqueous solution, as long as the surface conditioning solution can remove the magnesium oxide, release agent, dirt, and magnesium granules left behind in cold working, such as cutting process, from the surface of the magnesium alloy workpiece.

It is to be understood that the phosphating solution may include other ingredients, such as solutions including phosphoric acid and tannic acid.

For further explanation, detailed embodiments and comparative embodiments are described as follows.

Nine groups of magnesium alloy workpieces are provided. A material of the magnesium alloy workpieces is AZ91D type magnesium alloy. The first group through fourth group of magnesium alloy workpieces are conversion treated by the method of the illustrated embodiment of this disclosure, serving and provided as embodiment 1 through embodiment 4. The fifth group through ninth group of the magnesium alloy workpieces are conversion treated by other methods, serving and provided as comparative embodiment 1 through comparative embodiment 5. FIG. 2 shows the steps and respective corresponding parameters (i.e., the time period, temperature, and pH if applicable) of embodiments 1-4. The material ingredients and the concentrations of the solutions are described as follows. FIG. 3 shows the steps and respective corresponding parameters of comparative embodiments 1-5. The material ingredients and concentrations of the solutions are described as follows. After the magnesium alloy workpieces are conversion treated, five samples from each group are selected to undergo an impedance test and a salt spray test. FIG. 4 and FIG. 5 show the test results of the impedance test and the salt spray test. The salt spray test is carried out by a salt spray device using a sodium chloride solution having a mass concentration of 50±5 g/L. The salt spray test is carried out for about eight hours. A temperature in the salt spray device is kept at 35±2° C. Corrosion areas of the magnesium alloy workpieces are measured under the standard of JIS-Z2371. The impedance test is carried out by an impedance instrument (model: FLUKE multimeter 287c) and a probe. The probe, attached with a fixed pressure of about 0.5 N, is vertically positioned on the surface of the sample. The impedance test is applied to five test points of each sample.

Embodiment 1

The material ingredients and concentrations of the solutions are as follows.

In the degreasing step: the mass concentration of the sodium hydroxide is about 10 g/L, the mass concentration of the sodium carbonate is about 20 g/L, and the mass concentration of the sodium silicate is about 30 g/L.

In the first acid pickling treatment step: the volume concentration of the oxalic acid is about 20 mL/L, the mass concentration of the SDS is about 10 g/L, and the mass concentration of the ODEA is about 8 g/L.

In the first surface conditioning treatment step: the mass concentration of the sodium hydroxide is about 50 g/L, the mass concentration of the potassium hydroxide is about 50 g/L, and the mass concentration of the SDS is about 15 g/L.

In the second acid pickling treatment step: the volume concentration of the oxalic acid is about 60 mL/L, the mass concentration of the SDS is about 20 g/L, and the mass concentration of the oleic acid diethanolamide is about 3 g/L.

In the second surface conditioning treatment step: the mass concentration of the sodium hydroxide is about 50 g/L, the mass concentration of the potassium hydroxide is about 50 g/L, and the mass concentration of the SDS is about 15 g/L.

In the pre-phosphating treatment step: the volume concentration of the phosphoric acid is about 100 mL/L, the mass concentration of the manganese phosphate acid is about 10 g/L, the mass concentration of the calcium dihydrogen phosphate is about 20 g/L, the mass concentration of the sodium zirconate is about 10 g/L, the mass concentration of the sodium vanadate is about 4 g/L, the mass concentration of the sodium molybdate is about 0.5 g/L, and the mass concentration of the sodium silicate is about 0.5 g/L.

In the phosphating treatment step: the volume concentration of the phosphoric acid is about 30 mL/L, the mass concentration of the manganese phosphate acid is about 40 g/L, the mass concentration of the calcium dihydrogen phosphate is about 5 g/L; the mass concentration of the sodium zirconate is about 1 g/L, the mass concentration of the sodium vanadate is about 1 g/L, the mass concentration of the sodium molybdate is about 2 g/L, and the mass concentration of the sodium silicate is about 3 g/L.

Embodiment 2

The material ingredients and concentrations of the solutions are as follows.

In the degreasing step: the mass concentration of the sodium hydroxide is about 40 g/L, the mass concentration of the sodium carbonate is about 30 g/L, and the mass concentration of sodium silicate is about 50 g/L.

In the first acid pickling treatment step: the volume concentration of oxalic acid is about 60 mL/L, the mass concentration of SDS is about 20 g/L, and the mass concentration of ODEA is about 3 g/L.

In the first surface conditioning treatment step: the mass concentration of sodium hydroxide is about 90 g/L, the mass concentration of the potassium hydroxide is about 70 g/L, and the mass concentration of the SDS is about 5 g/L.

In the second acid pickling treatment step: the volume concentration of the oxalic acid is about 20 mL/L, the mass concentration of the SDS is about 15 g/L, the mass concentration of the oleic acid diethanolamide is about 8 g/L.

In the second surface conditioning treatment step: the mass concentration of the sodium hydroxide is about 90 g/L, the mass concentration of the potassium hydroxide is about 70 g/L, and the mass concentration of the SDS is about 5 g/L.

In the pre-phosphating treatment step: the volume concentration of phosphoric acid is about 30 mL/L, the mass concentration of the manganese phosphate acid is about 40 g/L, the mass concentration of the calcium dihydrogen phosphate is about 5 g/L, the mass concentration of the sodium zirconate is about 1 g/L, the mass concentration of the sodium vanadate is about 1 g/L, the mass concentration of the sodium molybdate is about 2 g/L, and the mass concentration of the sodium silicate is about 3 g/L.

In the phosphating treatment step: the volume concentration of the phosphoric acid is about 100 mL/L, the mass concentration of the manganese phosphate acid is about 10 g/L, the mass concentration of the calcium dihydrogen phosphate is about 20 g/L; the mass concentration of the sodium zirconate is about 10 g/L, the mass concentration of the sodium vanadate is 4 g/L, the mass concentration of the sodium molybdate is about 0.5 g/L, and the mass concentration of the sodium silicate is about 0.5 g/L.

Embodiment 3

The material ingredients and concentrations of the solutions are as follows:

In the degreasing step: the mass concentration of the sodium hydroxide is about 200 g/L, the mass concentration of the sodium carbonate is about 300 g/L, and the mass concentration of the sodium silicate is about 20 g/L.

In the first acid pickling treatment step: the volume concentration of oxalic acid is about 40 mL/L, the mass concentration of SDS is about 10 g/L, and the mass concentration of ODEA is about 3 g/L.

In the first surface conditioning treatment step: the mass concentration of sodium hydroxide is about 60 g/L, the mass concentration of potassium hydroxide is about 60 g/L, and the mass concentration of SDS is about 5 g/L.

In the second acid pickling treatment step: the volume concentration of oxalic acid is about 50 mL/L, the mass concentration of the SDS is about 16 g/L, and the mass concentration of the oleic acid diethanolamide is about 3 g/L.

In the second surface conditioning treatment step: the mass concentration of sodium hydroxide is about 60 g/L, the mass concentration of the potassium hydroxide is about 70 g/L, and the mass concentration of the SDS is about 5 g/L.

In the pre-phosphating treatment step: the volume concentration of the phosphoric acid is about 70 mL/L, the mass concentration of the manganese phosphate acid is about 30 g/L, the mass concentration of the calcium dihydrogen phosphate is about 15 g/L; the mass concentration of the sodium zirconate is about 2 g/L, the mass concentration of the sodium vanadate is about 1 g/L, the mass concentration of the sodium molybdate is about 1 g/L, and the mass concentration of the sodium silicate is about 0.5 g/L.

In the phosphating treatment step: the volume concentration of the phosphoric acid is about 70 mL/L, the mass concentration of the manganese phosphate acid is about 20 g/L, the mass concentration of the calcium dihydrogen phosphate is about 20 g/L, the mass concentration of the sodium zirconate is about 8 g/L, the mass concentration of the sodium vanadate is about 3 g/L, the mass concentration of the sodium molybdate is about 0.5 g/L, and the mass concentration of the sodium silicate is about 1 g/L.

Embodiment 4

The material ingredients and concentrations of the solutions are as follows:

In the degreasing step: the mass concentration of the sodium hydroxide is about 10 g/L, the mass concentration of the sodium carbonate is about 20 g/L, and the mass concentration of the sodium silicate is about 30 g/L.

In the first acid pickling treatment step: the volume concentration of the oxalic acid is about 20 mL/L, the mass concentration of the SDS is about 15 g/L, and the mass concentration of ODEA is about 8 g/L.

In the first surface conditioning treatment step: the mass concentration of the sodium hydroxide is about 50 g/L, the mass concentration of the potassium hydroxide is about 50 g/L, and the mass concentration of the SDS is about 15 g/L.

In the second acid pickling treatment step: the volume concentration of the oxalic acid is about 60 mL/L, the mass concentration of the SDS is about 20 g/L, and the mass concentration of the oleic acid diethanolamide is about 3 g/L.

In the second surface conditioning treatment step: the mass concentration of the sodium hydroxide is about 90 g/L, the mass concentration of the potassium hydroxide is about 70 g/L, and the mass concentration of the SDS is about 5 g/L.

In the pre-phosphating treatment step: the volume concentration of the phosphoric acid is about 40 mL/L, the mass concentration of the manganese phosphate acid is about 40 g/L, the mass concentration of the calcium dihydrogen phosphate is about 5 g/L, the mass concentration of the sodium zirconate is about 1 g/L, the mass concentration of the sodium vanadate is about 1 g/L, the mass concentration of the sodium molybdate is about 0.5 g/L, and the mass concentration of the sodium silicate is about 0.5 g/L.

In the phosphating treatment step: the volume concentration of the phosphoric acid is about 50 mL/L, the mass concentration of the manganese phosphate acid is about 30 g/L, the mass concentration of the calcium dihydrogen phosphate is about 10 g/L, the mass concentration of the sodium zirconate is about 2 g/L, the mass concentration of the sodium vanadate is about 3 g/L, the mass concentration of the sodium molybdate is about 0.5 g/L, and the mass concentration of the sodium silicate is about 0.5 g/L.

The conditions of the solutions in comparative embodiment 1 through comparative embodiment 5 are substantially the same as in embodiment 1.

As can be seen from the test results shown in FIGS. 4-5, the corrosion resistances of the magnesium alloy workpieces conversion treated by the method of this disclosure are better than the corrosion resistances of the magnesium alloy workpieces in comparative embodiments 1 through 5. Grades of the corrosion resistances in embodiments 1 through 4 of instant disclosure are eight or nine, and the surface resistances thereof are lower and more stable. The largest surface resistance in embodiments 1 through 4 is smaller than 0.8 ohm, and the average surface resistance is about 0.4 ohm. In comparative embodiments 1 through 5, the corrosion resistances of the magnesium alloy workpieces are worse, and the surface resistances are higher than those of the embodiments 1 through 4. Therefore, the magnesium alloy workpieces treated by the method of instant or present disclosure have a better corrosion resistance and a smaller surface resistance than those of the magnesium alloy workpieces in comparative embodiments. When the magnesium alloy workpieces of embodiments of present disclosure are used in portable electronic devices, electromagnetic shielding of the portable electronic devices is higher.

Figure 6:
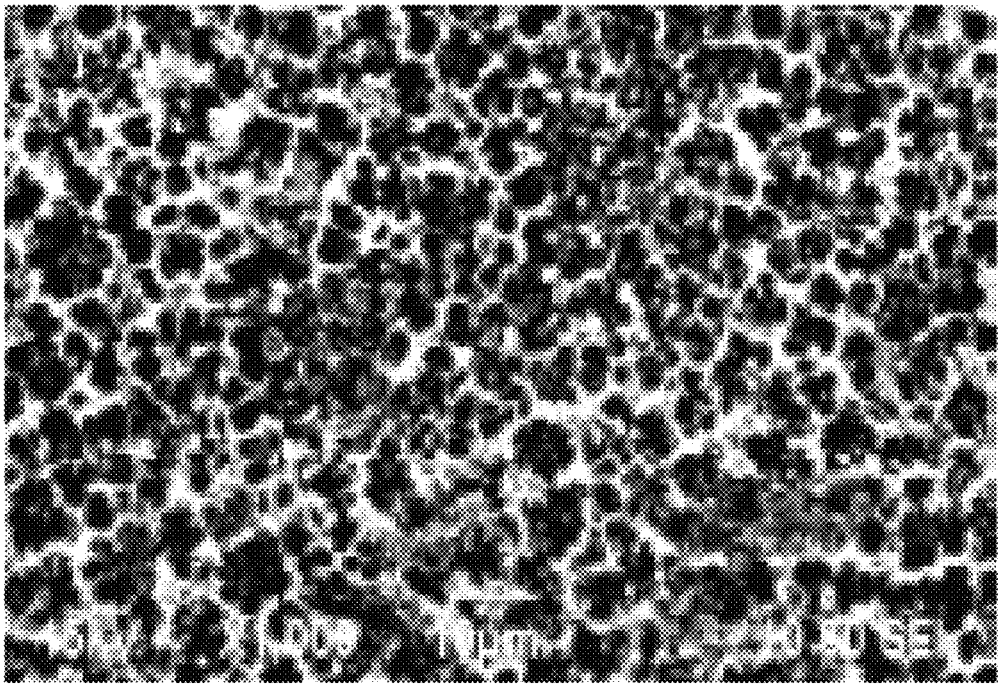
FIG. 6 is a scanning electron microscope image of the surface of the magnesium alloy workpiece in embodiment 1.

In the method for conversion treating surfaces of the magnesium alloy workpieces of instant or present disclosure, because the magnesium alloy workpiece is treated by acid pickling and has been surface conditioned two times, the oxides, the release agent, the dirt, and the magnesium scrap left behind in cold working, such as cutting process, and other residues on the surface of the magnesium alloy workpieces are thoroughly removed. After the pre-phosphating treatment step, the residual solution of the surface conditioning treatment step is neutralized. Thus, the phosphating film residing on the surface of the magnesium alloy workpiece is uniform and dense (as shown in FIG. 6, FIG. 6 shows a scanning electron microscope image of the surface of the magnesium alloy workpiece in embodiment 1). Therefore, the corrosion resistance of the phosphating film is better, and the surface resistance is lower.

It is believed that the present embodiments and their advantages will be understood from the foregoing description, and it will be apparent that various changes may be made thereto without departing from the spirit and scope of the embodiments or sacrificing all of its material advantages.

What is claimed is:

1. A method for conversion treating surface of a magnesium alloy workpiece comprising:

providing a magnesium alloy workpiece;

placing the magnesium alloy workpiece in a degreasing solution to remove oil from a surface thereof;

placing the magnesium alloy workpiece in an acid pickling solution in a first acid pickling treatment step to remove oxides, release agent, dirt and magnesium granules left behind in cold working adhered on the surface thereof;

placing the magnesium alloy workpiece in a surface conditioning solution in a first surface conditioning treatment step to remove residues adhered on the surface thereof after the first acid pickling treatment step;

placing the magnesium alloy workpiece in the acid pickling solution in a second acid pickling treatment step to further remove oxides, release agent, dirt and magnesium granules left behind in cold working adhered on the surface thereof;

placing the magnesium alloy workpiece in the surface conditioning solution in a second surface conditioning treatment step to remove residues adhered on the surface thereof after the second acid pickling treatment step;

placing the magnesium alloy workpiece in a pre-phosphating solution in a pre-phosphating treatment step to neutralize a residual solution on the surface thereof after the second surface conditioning treatment step;

placing the magnesium alloy workpiece in a phosphating solution in a phosphating treatment step to form a phosphating film on the surface thereof; wherein the phosphating solution comprises phosphoric acid, manganese phosphate acid, calcium dihydrogen phosphate, sodium zirconate, sodium vanadate, and sodium molybdate, and sodium silicate.

2. The method for conversion treating surface of the magnesium alloy workpiece as in claim 1, wherein the time period of phosphating treatment step is in a range from about 15 seconds to about 40 seconds, and the temperature of the phosphating solution is in a range from about 20 degrees centigrade to about 35 degrees centigrade.

3. The method for conversion treating surface of the magnesium alloy workpiece as in claim 1, wherein in the phosphating treatment step, a volume concentration of the phosphoric acid is in a range from about 30 mL/L to about 100 mL/L, a mass concentration of the manganese phosphate acid is in a range from about 10 g/L to about 40 g/L, a mass concentration of the calcium dihydrogen phosphate is in a range from about 5 g/L to about 20 g/L, a mass concentration of the sodium zirconate is in a range from about 1 g/L to about 10 g/L, a mass concentration of the sodium vanadate is in a range from about 1 g/L to about 4 g/L, a mass concentration of the sodium molybdate is in a range from about 0.5 g/L to about 2 g/L, and a mass concentration of the sodium silicate is in a range from about 0.5 g/L to about 3 g/L.

4. The method for conversion treating surface of the magnesium alloy workpiece as in claim 3, wherein in the phosphating treatment step, the pH value of the phosphating solution is in a range from about 1.95 to about 2.15.

5. The method for conversion treating surface of the magnesium alloy workpiece as in claim 1, wherein the time period of the first acid pickling treatment step is in a range from about 0.5 minute to about 1 minute, and the temperature is in a range from about 60 degrees centigrade to about 70 degrees centigrade.

6. The method for conversion treating surface of the magnesium alloy workpiece as in claim 1, wherein in the first acid pickling treatment step, the acid pickling solution comprises oxalic acid, sodium dodecyl sulfate, and oleic acid diethanolamide.

7. The method for conversion treating surface of the magnesium alloy workpiece as in claim 1, wherein the time period of the first surface conditioning treatment step is in a range from about 0.5 minute to about 1 minute, and the temperature is in a range from about 60 degrees centigrade to about 70 degrees centigrade.

8. The method for conversion treating surface of the magnesium alloy workpiece as in claim 1, wherein the time period of the pre-phosphating treatment step is in a range from about 10 seconds to about 25 seconds.

9. The method for conversion treating surface of the magnesium alloy workpiece as in claim 8, wherein in the pre-phosphating treatment step, the pH of the pre-phosphating solution is in a range from about 1.75 to about 1.90.

10. A method for conversion treating surface of a magnesium alloy workpiece comprising:

providing a magnesium alloy workpiece;

placing the magnesium alloy workpiece in a degreasing solution to remove oil from a surface thereof;

placing the magnesium alloy workpiece in an acid pickling solution in a first acid pickling treatment step to remove oxides, release agent, dirt and magnesium granules left behind in cold working adhered on the surface thereof, the acid pickling solution comprising oxalic acid, sodium dodecyl sulfate, and oleic acid diethanolamide;

placing the magnesium alloy workpiece in a surface conditioning solution in a first surface conditioning treatment step to remove residues adhered on the surface thereof after the first acid pickling treatment step;

placing the magnesium alloy workpiece in the acid pickling solution in a second acid pickling treatment step to further remove oxides, release agent, dirt and magnesium granules left behind in cold working adhered on the surface thereof;

placing the magnesium alloy workpiece in the surface conditioning solution in a second surface conditioning treatment step to remove residues adhered on the surface thereof after the second acid pickling treatment step;

placing the magnesium alloy workpiece in a pre-phosphating solution in a pre-phosphating treatment step to neutralize a residual solution on the surface thereof after the second surface conditioning treatment step;

placing the magnesium alloy workpiece in a phosphating solution in a phosphating treatment step to form a phosphating film on the surface thereof.

11. The method for conversion treating surface of the magnesium alloy workpiece as in claim 10, wherein the time period of phosphating treatment step is in a range from about 15 seconds to about 40 seconds, and the temperature of the phosphating solution is in a range from about 20 degrees centigrade to about 35 degrees centigrade.

12. The method for conversion treating surface of the magnesium alloy workpiece as in claim 10, wherein the phosphating solution comprises phosphoric acid, manganese phosphate acid, calcium dihydrogen phosphate, sodium zirconate, sodium vanadate, and sodium molybdate, and sodium silicate.

13. The method for conversion treating surface of the magnesium alloy workpiece as in claim 12, wherein in the phosphating treatment step, a volume concentration of the phosphoric acid is in a range from about 30 mL/L to about 100 mL/L, a mass concentration of the manganese phosphate acid is in a range from about 10 g/L to about 40 g/L, a mass concentration of the calcium dihydrogen phosphate is in a range from about 5 g/L to about 20 g/L, a mass concentration of the sodium zirconate is in a range from about 1 g/L to about 10 g/L, a mass concentration of the sodium vanadate is in a range from about 1 g/L to about 4 g/L, a mass concentration of the sodium molybdate is in a range from about 0.5 g/L to about 2 g/L, and a mass concentration of the sodium silicate is in a range from about 0.5 g/L to about 3 g/L.

14. The method for conversion treating surface of the magnesium alloy workpiece as in claim 13, wherein in the phosphating treatment step, the pH value of the phosphating solution is in a range from about 1.95 to about 2.15.

15. The method for conversion treating surface of the magnesium alloy workpiece as in claim 10, wherein the time period of the first acid pickling treatment step is in a range from about 0.5 minute to about 1 minute, and the temperature is in a range from about 60 degrees centigrade to about 70 degrees centigrade.

16. The method for conversion treating surface of the magnesium alloy workpiece as in claim 10, wherein the time period of the first surface conditioning treatment step is in a range from about 0.5 minute to about 1 minute, and the temperature is in a range from about 60 degrees centigrade to about 70 degrees centigrade.

17. The method for conversion treating surface of the magnesium alloy workpiece as in claim 10, wherein the time period of the pre-phosphating treatment step is in a range from about 10 seconds to about 25 seconds.

18. The method for conversion treating surface of the magnesium alloy workpiece as in claim 17, wherein in the pre-phosphating treatment step, the pH of the pre-phosphating solution is in a range from about 1.75 to about 1.90.

* * * * *